US010751561B2

(12) United States Patent
Yakovenko et al.

(10) Patent No.: US 10,751,561 B2
(45) Date of Patent: Aug. 25, 2020

(54) SYSTEMS AND METHODS FOR CONTROLLING A SELF-PACED TREADMILL USING PREDICTED SUBJECT VELOCITY

(71) Applicant: West Virginia University, Morgantown, WV (US)

(72) Inventors: Sergiy Yakovenko, Morgantown, WV (US); Matthew Boots, Morgantown, WV (US)

(73) Assignee: WEST VIRGINIA UNIVERSITY, Morgantown, WV (US)

( * ) Notice: Subject to any disclaimer, the term of this patent is extended or adjusted under 35 U.S.C. 154(b) by 154 days.

(21) Appl. No.: 15/991,497

(22) Filed: May 29, 2018

(65) Prior Publication Data

US 2018/0345070 A1 Dec. 6, 2018

Related U.S. Application Data

(60) Provisional application No. 62/512,432, filed on May 30, 2017.

(51) Int. Cl.

| | |
|---|---|
| ***A63B 22/02*** | (2006.01) |
| ***A63B 24/00*** | (2006.01) |
| ***A63B 71/06*** | (2006.01) |

(52) U.S. Cl.

CPC ..... *A63B 22/0242* (2013.01); *A63B 22/025* (2015.10); *A63B 22/0292* (2015.10);

(Continued)

(58) Field of Classification Search

CPC ..... G06K 9/00348; G06K 9/00342; G06K 9/00335; G16H 20/30; A63B 24/00; A63B 24/0003; A63B 24/0006; A63B 24/0012; A63B 24/0075; A63B 24/0087; A63B 2024/009; A63B 2024/0025; A63B 2024/0037; A63B 2024/0043; A63B 2024/0056; A63B 2024/0068; A63B 2024/0093; A63B 2024/0096; A63B 2220/00; A63B 2220/13; A63B 5/22; A63B 22/00; A63B 22/0015; A63B 22/0025;

(Continued)

(56) References Cited

U.S. PATENT DOCUMENTS

| | | | | |
|---|---|---|---|---|
| 2017/0095670 | A1* | 4/2017 | Ghaffari | A61B 5/0024 |
| 2019/0090820 | A1* | 3/2019 | Schwenk | A61B 5/721 |

OTHER PUBLICATIONS

Force Treadmill for Measuring Vertical and Horizontal Ground Reaction Forces (Year: 1998).*

(Continued)

*Primary Examiner* — Sundhara M Ganesan

(74) *Attorney, Agent, or Firm* — Thomas | Horstemeyer, LLP

(57) ABSTRACT

Systems and methods are provided for enabling a split belt treadmill having two belts to self-pace. A feedback process estimates a first current step speed for a user on each belt by measuring stride length and step duration. A feed-forward process estimates a second current step speed for the user on each belt by measuring three forces and three moment components associated with foot contact with the belt. A command speed for each belt is produced by combining the first and second current step speeds with a Kalman filter. A belt speed associated with each belt is adjusted based upon the command speed.

20 Claims, 9 Drawing Sheets

(52) U.S. Cl.
CPC ..... *A63B 24/0087* (2013.01); *A63B 71/0622* (2013.01); *A63B 2024/0009* (2013.01); *A63B 2024/0012* (2013.01); *A63B 2024/0037* (2013.01); *A63B 2024/0078* (2013.01); *A63B 2024/0093* (2013.01); *A63B 2024/0096* (2013.01); *A63B 2071/0638* (2013.01); *A63B 2071/0666* (2013.01); *A63B 2220/10* (2013.01); *A63B 2220/13* (2013.01); *A63B 2220/17* (2013.01); *A63B 2220/22* (2013.01); *A63B 2220/30* (2013.01); *A63B 2220/53* (2013.01); *A63B 2220/62* (2013.01); *A63B 2220/803* (2013.01); *A63B 2220/836* (2013.01); *A63B 2225/20* (2013.01); *A63B 2225/50* (2013.01)

(58) Field of Classification Search
CPC ... A63B 22/02; A63B 22/0242; A63B 22/025; A63B 22/0257; A63B 22/0271; A63B 22/0292; A63B 2022/002; A63B 2022/003; A63B 2022/0038; A63B 2022/0092; A63B 23/00; A63B 23/03533; A63B 23/03541; A63B 71/0619; A63B 71/0622; A63B 71/0636; A63B 71/0638; A63B 71/0647; A63B 2220/62; A63B 2220/836; A63B 2024/0078; A63B 2220/10; A63B 2220/22; A63B 2071/0666; A63B 2220/803; A63B 2225/50; A63B 2024/0012; A63B 2220/17; A63B 2220/53; A63B 2225/20; A63B 2220/30; A63B 2071/0638; A63B 2024/0009; G06F 19/3481; A61B 5/1038; A61B 5/112; A61B 5/116; A61B 5/117
See application file for complete search history.

(56) References Cited

OTHER PUBLICATIONS

The Integrated Virtual Environment Rehabilitation Treadmill System (Year: 2001).*
Notre Dame Measurement Error (Year: 2015).*
Kim, .J., Grav under, A .. Stanley, C. J., & Park, r l. S. (2013). Low-cost implementation of a self-paced treadmill by using a commercial depth sensor. Proceedings of the Annual International Conference of the IEEE Engineering in Medicine and Biology Society, EMBS, 874-877.
(2) Lichtenstein. L., Barabas, .J., Woods, R. L., & Peli, E. (2007). A feedback-controlled interface for treadmill locomotion in vi1tual environments. ACM Transactions on Applied Perception, 4( I). 7-es.
(3) Minetti. A. L Boldrini. L., Brusamolin, L., Zamparo, P., & McKee, T. (2003). A feedback-controlled treadmill (treadmill-on-demand) and the spontaneous speed of walking and running in humans. Journal of Applied Physiology (BetJ1esda. Md.: 1985 ), 95(2). 838-843.
Boots, M. T., & Yakovenko, S. (2018). Self-paced omnidirectional locomotion in virtual reality using a split-belt treadmill. SfN Annual Meeting. San Diego.

* cited by examiner

SYSTEMS AND METHODS FOR CONTROLLING A SELF-PACED TREADMILL USING PREDICTED SUBJECT VELOCITY

CROSS REFERENCE TO RELATED APPLICATIONS

This application claims priority to, and the benefit of, U.S. provisional application entitled "SELF-PACED TREADMILL ALGORITHM USING GROUND REACTION SIGNALS TO PREDICT SUBJECT VELOCITY" having Ser. No. 62/512,432, filed May 30, 2017 and which is incorporated herein by reference in its entirety.

BACKGROUND

Locomotion in humans must be flexible enough to accommodate changing environment demands and task constraints. Achieving this requires modification of intra- and inter-limb coordination without loss of stability. Reactive changes rapidly occur using peripheral feedback (e.g., increasing your step height to clear a curb after you catch your toe on it). Slower adaptive changes depend on practice and occur over minutes to hours (e.g., changing your walking pattern to adjust to new shoes). They result in new calibrations of feedforward motor commands, which cause after-effects that persist when the demands are removed.

Normally, both types of locomotor adjustments can be made with ease. For example, when people walk on a split-belt treadmill that moves each leg at a different speed, there is an immediate reaction such that the slower leg spends more time in stance and the faster leg spends less time in stance. This reaction persists during split-belt walking, and then immediately reverses when the belts are returned to normal treadmill conditions (i.e., the belts tied at the same speed). In contrast, step lengths also are initially asymmetric, but an adaptive response occurs during split-belt walking that acts to re-establish symmetry via feedforward changes in phasing between legs. This adaptation induces an after-effect, causing walking asymmetry when returned to normal treadmill conditions.

The leg speed asymmetry is a part of natural regulation of the change in the heading direction. The differences in speeds have previously been viewed as a complication to the explanation of turning strategies; however, the velocity-dependent turning has now been explained by the dynamics of central pattern generation within the spinal neural circuitry. During the locomotion on the split-belt treadmill, the quality of robust turning control relies on the congruent experience of changes in the peripheral flow of visual information, the appropriate detection of limb speeds, and the success of decoupling the twisting action at the hip from stepping modifications.

With the advent of modern-day exercise machines, self-paced treadmills were created that enable the continuous adjustment of speed based on the user's own performance and adjustments. The original goal of self-paced systems was to keep the user in the center of the treadmill and automate safety measures. While these systems were the first to utilize feedback algorithms that reported on the subject's position relative to the treadmill, they almost always used external devices that facilitated motion/video capture, such as an ultrasonic range finder or a feedback-controlled locomotion interface. The sensor can be implemented with a force transducer in line with a tether connecting subject to the front of treadmill.

SUMMARY OF THE INVENTION

Included are various embodiments of systems and methods related to enabling a split belt treadmill having two belts to self-pace. One embodiment of a method, among others, includes a method to enable each belt of a split belt treadmill to self-pace. The method comprises performing a feedback process that estimates a first current step speed for a user by measuring stride length and step duration, performing a feed-forward process that estimates a second current step speed for the user by measuring three forces and three moment components associated with foot contact with the belt, producing a command speed for the belt by combining the first and second current step speeds with a Kalman filter, and adjusting a belt speed associated with the belt based at least in part upon the command speed.

One embodiment of a system, among others includes, a system that comprises a treadmill, at least one computing device, and at least one application executable in the at least one computing device. When executed, the least one application causes the at least one computing device to at least: (1) receive sensor data associated with a subject interacting with the treadmill, (2) estimate a first current step speed and a second current step speed based at least in part on the sensor data, (3) determine a time-varying speed command by combining the first current step speed and the second current step speed, and (4) transmit the time-varying speed command to the treadmill, wherein a belt speed of a belt of the treadmill is adjusted based at least in part on the time-varying speed command.

Another embodiment of a system, among others includes, a system that comprises means for measuring leg movement of a subject interacting on a treadmill, means for estimating a first current speed of the leg movement, means for estimating a second current speed of the leg movement, means for combining the first and second current step speeds to generate a command speed, and means for adjusting a belt speed of a belt of a treadmill based at least in part upon the command speed.

Other embodiments, methods, features, and advantages of the present invention will be or become apparent to one with skill in the art upon examination of the following drawings and detailed description. It is intended that all such additional systems, methods, features, and advantages be included within this description, within the scope of the present invention, and protected by the accompanying claims.

BRIEF DESCRIPTION OF THE DRAWINGS

The foregoing will be apparent from the following more particular description of example embodiments of the present disclosure, as illustrated in the accompanying drawings in which like reference characters refer to the same parts throughout the different views. The drawings are not necessarily to scale, emphasis instead being placed upon illustrating embodiments of the present disclosure.

FIG. 3A shows an example of the vertical ground reaction forces (GRF) (top) and the calculated limb speed (bottom). GRFs were used here as an example but this calculation could be done with the other sensor data described in FIG. 1. FIG. 3B shows a diagram to help visualize the FB module.

FIG. 4A corresponds to the ground force direction $F_x$. FIG. 4B corresponds to the ground force direction $F_y$. FIG. 4C corresponds to the ground force direction $F_z$. The bottom portions of FIGS. 4A-4C illustrate examples of comparing of comparing a partial step profile to the dataset of locomotor profiles to determine the speed of the leg. The recorded force is compared to the dataset profiles yielding the best correlation with the profile with the closest matching speed.

DETAILED DESCRIPTION OF EMBODIMENTS

The present disclosure provides various embodiments of systems and methods of a self-paced treadmill where the speed of each treadmill belt is based at least in part on the speed of the subject's leg. According to various embodiments, the self-based treadmill can comprise a split-belt treadmill (e.g., Bertece, Woodwaye treadmills) that is configured to self-pace by measuring leg motion. The leg motion can be measured with ground reaction forces (GRF) obtained via GRF sensors in the treadmill without the use of any additional subject instrumentation, with wearable kinematic sensors (e.g., virtual tracker, inertial measurement unit (IMU), etc.) tracking leg position, and/or any with any other type of sensor that can measure leg motion as can be appreciated. The sensor data acquired from the sensor(s) can be used to compute spatiotemporal leg progression relative to the treadmill via two simultaneous processes. The first, called a feedback process (FB), calculates current step speed by measuring stride length and step duration. The second process, called a feed-forward process (FF), calculates current step speed using available incomplete step sensor data and prior dataset relating sensor data to speeds.

The speed estimate computed from predictions of foot contact and lift-off in FF process is combined with the calculation of speed from recorded foot position and the velocity of the treadmill belt in FB process. The FF and FB estimates are combined to generate a time-varying speed command for each treadmill belt. The speed command separately adjusts the velocity of the treadmill belts by matching them to the speed of each of the user's legs. This constitutes a mechanism for the split-belt treadmill to be self-paced.

In some embodiments, the self-paced treadmill can be in combination with a virtual reality (VR) environment. For example, a VR environment can be created and then displayed to the subject via a virtual reality headset. The treadmill belt speeds calculated via the control system can be sent to the treadmill and to VR environment at the same time. This allows the person and the avatar in the virtual environment to move in the same way the control of heading direction can be expressed as the differential signal between belt speeds for the locomotion on a curved path that does not require abrupt turning.

In the following discussion, a general description of the system and its components is provided, followed by a discussion of the operation of the same.

Figure 1:
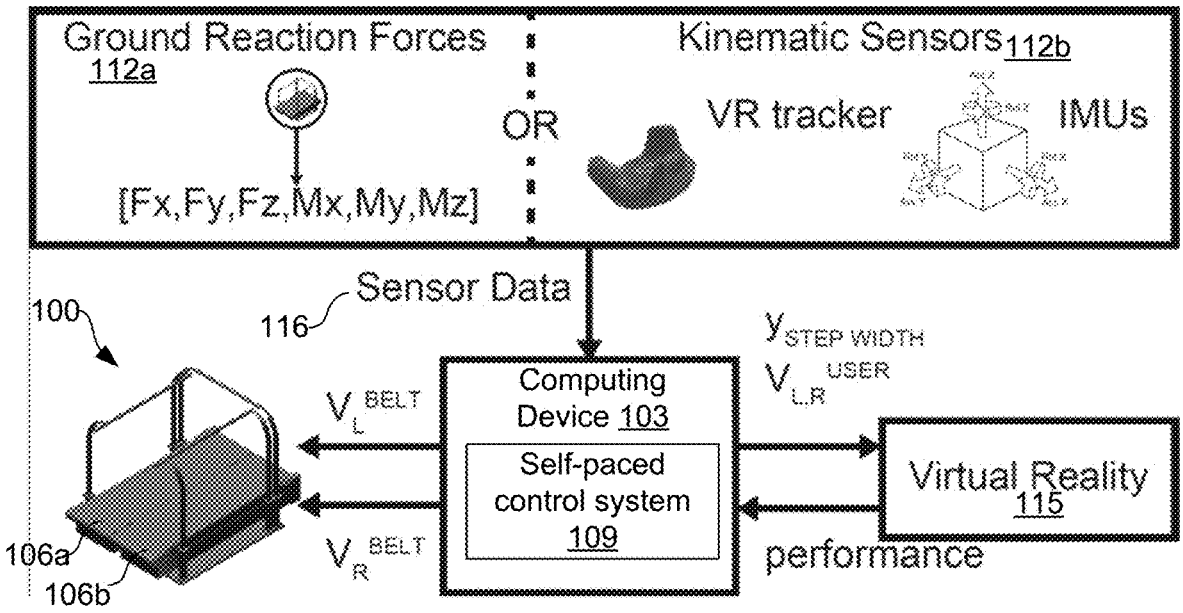
FIG. 1 is an example of a schematic block diagram showing an input-output information flow between hardware and software to enable self-paced locomotion in virtual reality environment (VR) according to various embodiments of the present disclosure. Examples of the shown hardware could be used to acquire the sensor data for computing phase transitions and foot placement, which are essential for the computing limb speeds on the treadmill belts according to various embodiments of the present disclosure.

As illustrated in FIG. 1, shown is an example of a schematic block diagram showing an input-output information flow between hardware and software to enable self-paced locomotion in virtual reality environment (VR) according to various embodiments of the present disclosure. In particular, shown is a self-paced treadmill 100 (SPT) in data communication with a computing device 103. According to various embodiments, the self-paced treadmill 100 comprises a split-belt treadmill where the speed of each treadmill belt 106 (e.g., 106*a*, 106*b*) is controlled via a self-paced control system 109 executed in the computing device 103. The computing device 103 is also in data communication with sensors 112 (e.g., 112*a*, 112*b*) that are able to acquire sensor data used to measure leg movement of a subject 114 (FIG. 3B) interacting with the treadmill 100 according to various embodiments of the present disclosure.

For example, in some embodiments, the split-belt treadmill 100 can be instrumented with ground reaction force (GRF) sensors 112*a* placed under each belt 106. In other embodiments, the sensors 112 can comprise kinematic sensors 112*b* that are worn by the subject interacting with the treadmill 100. According to various embodiments, the self-paced control system 109 executed in the computing device 103 is configured to calculate the respective velocities for each belt of the self-paced treadmill 100 and transmit the velocities to the treadmill 100. Further, FIG. 1 further shows a rendering of the hardware and software for SPT 100 with a VR environment 115. The VR environment 115 is in data communication with the computing device 103. For example, in some embodiments, self-paced control system 109 can send the calculated velocities to the treadmill 100 and to VR environment 115 at the same time. Kinetic and kinematic signals could be used to track phase transitions and foot placement. In some examples, the custom processes of the control application were developed using Matlab (MathWorks, Inc) to determine subject's leg speed based on sensor data 116 transmitted from the sensors 112 to the computing device 103 from each limb.

A. Overview of the Control System

Figure 2:
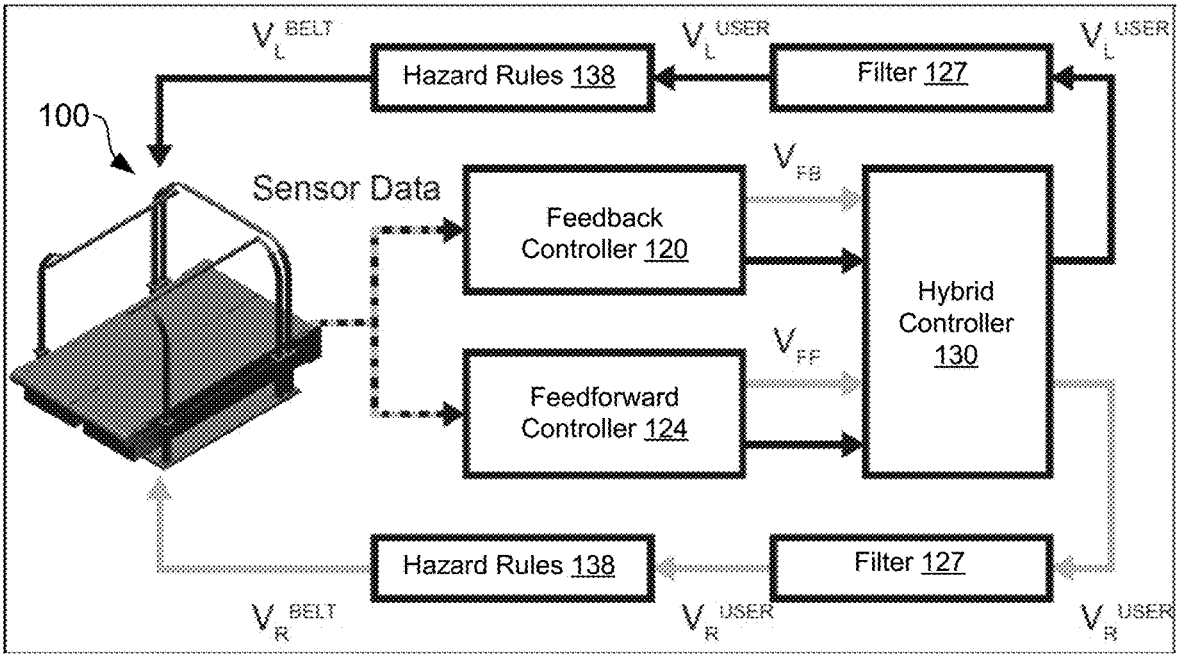
FIG. 2 is an example of a diagram showing an embodiment of a control system environment using ground reaction signals as the example to predict a velocity for each leg associated with a subject interacting with a split-belt treadmill according to various embodiments of the present disclosure.

The self-paced control system 109 of the present disclosure has two components, a feedback (FB) controller 120 and feedforward (FF) controller 124, that estimate the current limb speed, each using a different estimation method. The FB controller 120 uses observed phase durations, distance traveled on the treadmill, and treadmill belt speeds to calculate a speed estimate. The FF controller 124 uses the current GRF profiles and compares them to recorded profiles at different speeds. These estimates are then combined in a filter 127, (e.g., Kalman filter) to track individual treadmill belt speeds through time. FIG. 2 shows an example of a signal processing diagram for the system according to various embodiments.

B. Kalman Filter

Since the creation of the Kalman filter, it has been applied in many engineering applications, including global positioning system receivers, smoothing the output from a laptop trackpad, etc. It benefits from having small computational requirements and its recursive properties. Briefly, the Kalman filter is a data fusion algorithm that is used to track the state of a dynamic system through time while updating the state with noisy measurements. This is accomplished by knowing the state of a system at time t and having an estimate of the system state at time t+1. Measurements are taken at time t+1, and fused with the system state over time through the Kalman filter equations, as follows:

$$k = \frac{\sigma_{x_{i-1}}^2}{\sigma_{x_{i-1}}^2 - \sigma_y^2} \quad \text{Eq. 1}$$

$$x_i = x_{i-1} + k(y_1 - x_{i-1}) \quad \text{Eq. 2}$$

$$\sigma_{x_i}^2 = \sigma_{x_{i-1}}^2 - k\sigma_y^2 + Q_i \quad \text{Eq. 3}$$

The x parameter is the state of the system with $\sigma_x$ and $\sigma_y$ being the uncertainty of the measurements of x and y, respectively; i is the current time step; and Q is additional uncertainty from the environment. Equation 1 is the calculation of the kalman gain parameter, Equation 2 is the calculation of the new best estimate based on the previous estimate and the measurement, and Equation 3 is the uncertainty of the new estimate based on the uncertainty of the old estimate with the additional uncertainty from the environment.

C. Feedback Controller

Figure 3A:
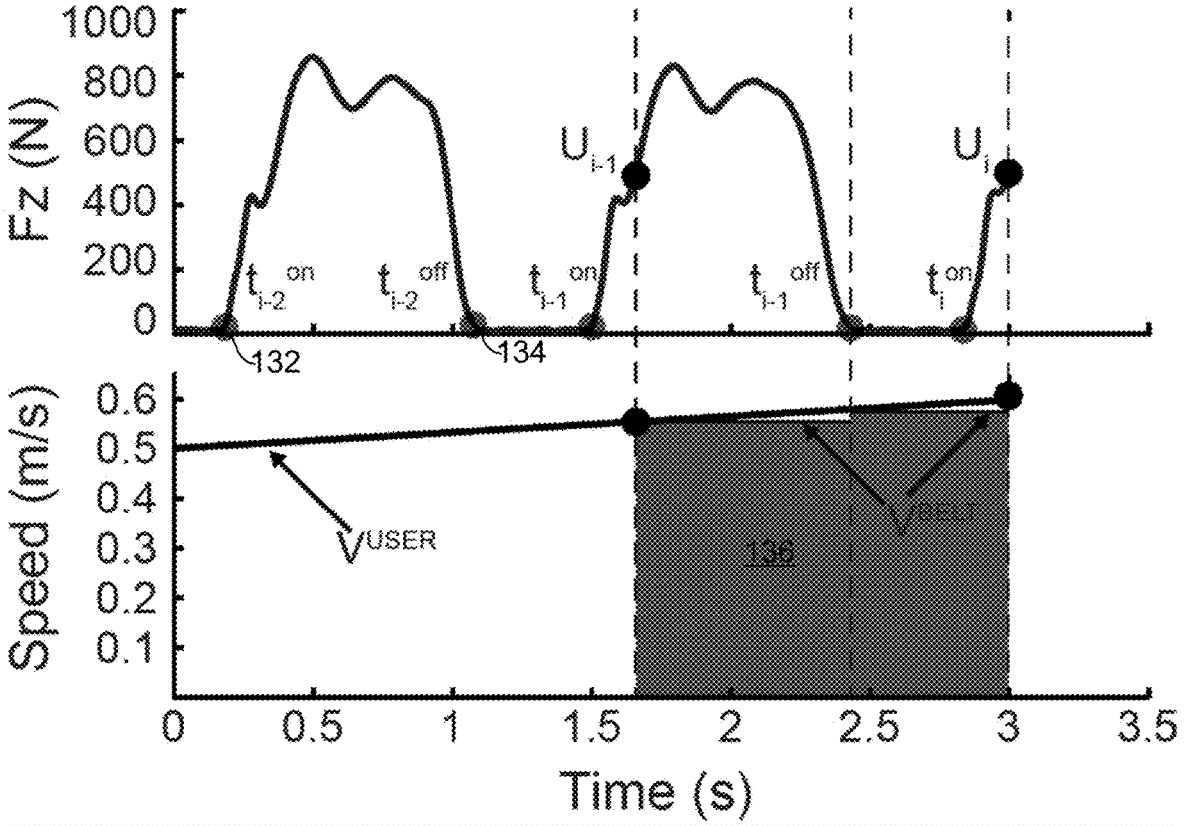
FIGS. 3A and 3B are diagrams showing the one-step behind calculation of limb velocity in the control system of FIG. 2. Specifically.
Figure 3B:
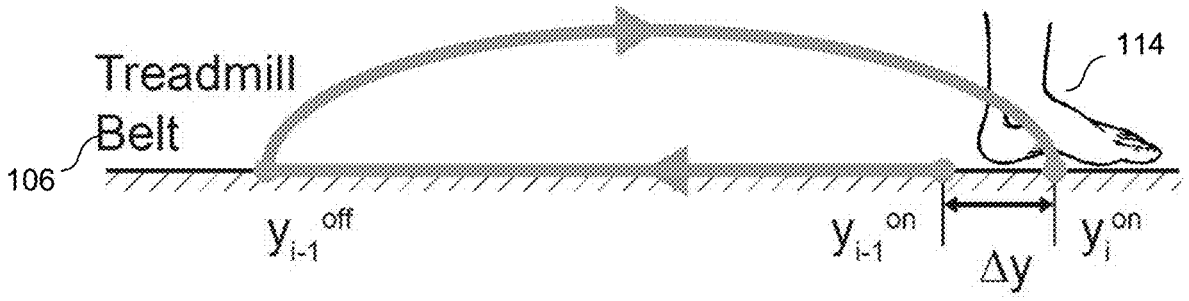

According to various embodiments, the FB controller 120 of the treadmill calculates the step speed as the ratio of distance that the subject's foot traveled to the time of one full step cycle. Since the update of command must wait for one full step cycle to be completed, there is a delay in the new belt speed calculation, and thus this is considered a FB mechanism. There are two events during the step that can be used to calculate the speed: the onset of foot stance and the offset of foot stance. FIGS. 3A and 3B are example diagrams showing the one-step behind calculation of limb velocity in the FB controller 120 of FIG. 2. In particular, FIG. 3A illustrates an example of the vertical GRF (top) and the calculated limb speed (bottom) using the onset of foot stance 132 and the offset of foot stance 134. These distinctive events in the step cycle can be used to calculate the speed by calculating distance traveled from onset to onset, or offset to offset of the foot as shown in FIG. 3B.

The distance is a sum of the integrated belt speed for a full step cycle 136 and the distance of subject's movement forward or backward on the treadmill (the nominator in Equation 4). V is the velocity of the treadmill belt, t is the time of events marking a full step, Δy is the change in foot contact location between two events marking the step cycle time Tc, e.g., from onset to onset of stance phases, i is the current step, and U is the speed calculation at the onset of stance, which also corresponds to the speed command calculated by the FB controller 120 in FIG. 2. This calculation can also be done at each stance offset, when limb leaves the ground.

$$U_i = \frac{\int_{t_{i-1}}^{t_i} V dt + \Delta y}{T_c} \quad \text{Eq. 4}$$

The second part needed, aside from the measurement itself, is the estimate of uncertainty of the given measurement, which was derived from a walking dataset consisting of trials with different treadmill velocity ramp profiles. The uncertainty estimate is based on the accumulating errors between the real-time speed and the output of Equation 4 for steps with changing speed. The inaccuracies in the estimates from feedback are due to the potential volitional change in speed between time $t_i$ and the current time. The errors and, consequently, the uncertainty of velocity command increase during the period between the measurements. The profile of errors between estimated and measured speeds is derived empirically from a dataset recorded for the locomotion of multiple subjects on the accelerating and decelerating treadmill belts. The standard parametric and nonparametric measures of variance provide the uncertainty value, which is passed to the hybrid controller shown in FIG. 2 along with the speed estimate.

D. Feedforward Controller

According to various embodiments, the FF controller 124 estimates the current speed of legs using partial GRF profiles recorded at the onset of the foot stance. This method relies on prior measurements of GRF profiles recorded systematically or opportunistically from a subject walking at different speeds. The GRF profiles from each step are binned according to the observed speed and inserted into the multidimensional matrix. The data is binned with task-dependent increments, where 0.1 m/s bin is sufficient for regular locomotion, and up to 0.01 m/s resolution for precise locomotor tasks, for example the analysis of just noticeable difference (JND) in interlimb velocity. Twenty steps are sufficient to estimate subject-specific mean of GRF profile for each bin. The intermediate results are calculated from the sparse data representations as the interpolation between the profiles in the adjacent bins. The resulting relationship is the GRF database for each leg for a range of speeds. The range of speeds is expanded by the updates of observed steps outside of the database range. The additional stepping data is used to incrementally update the database.

Figure 4A:
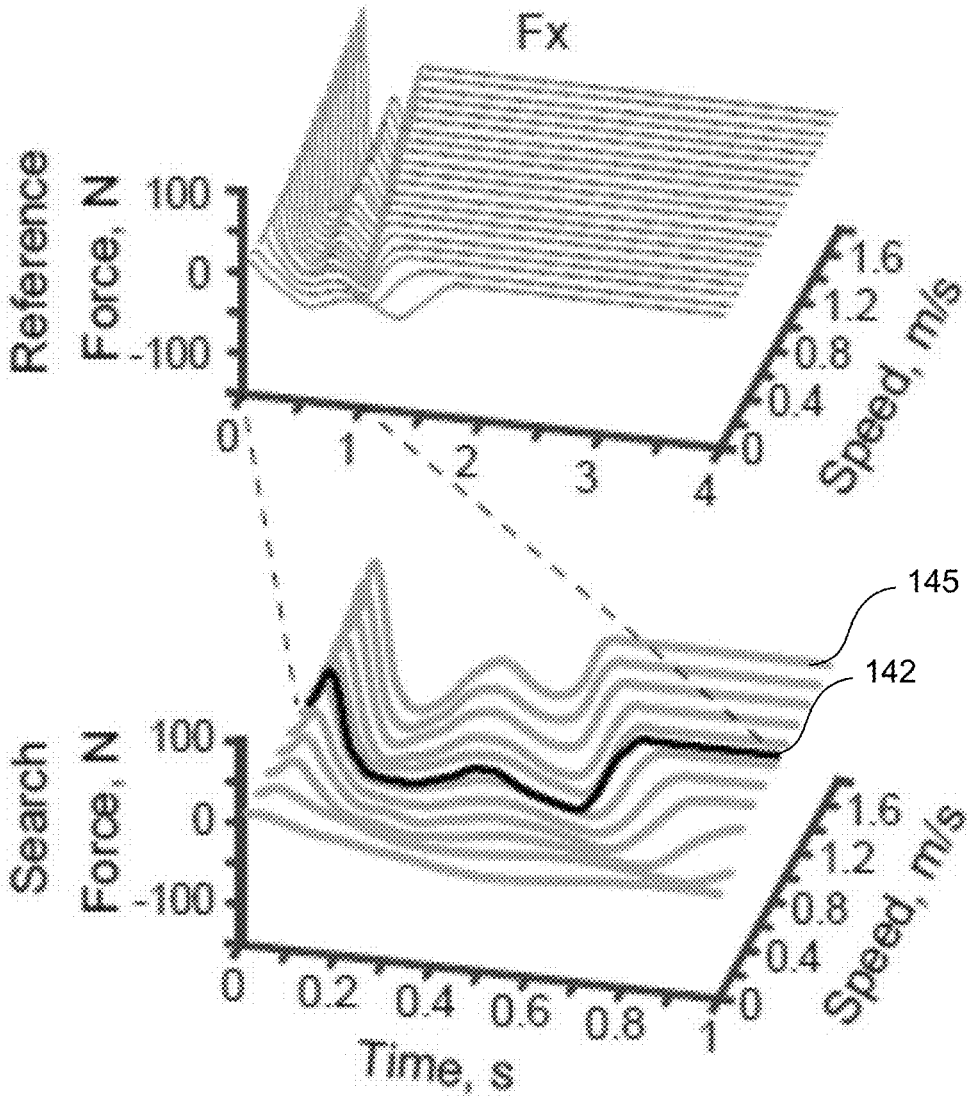
FIGS. 4A-4C (top) are examples of graphs showing the ground reaction force surfaces created by walking at different speeds according to various embodiments of the present disclosure.
Figure 4B:
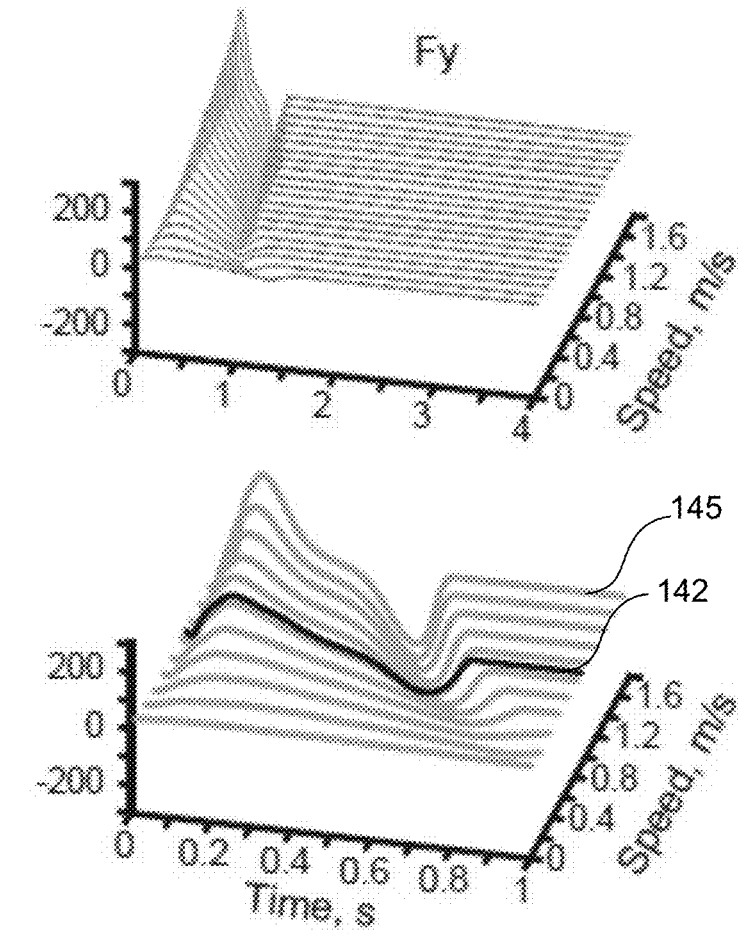
Figure 4C:
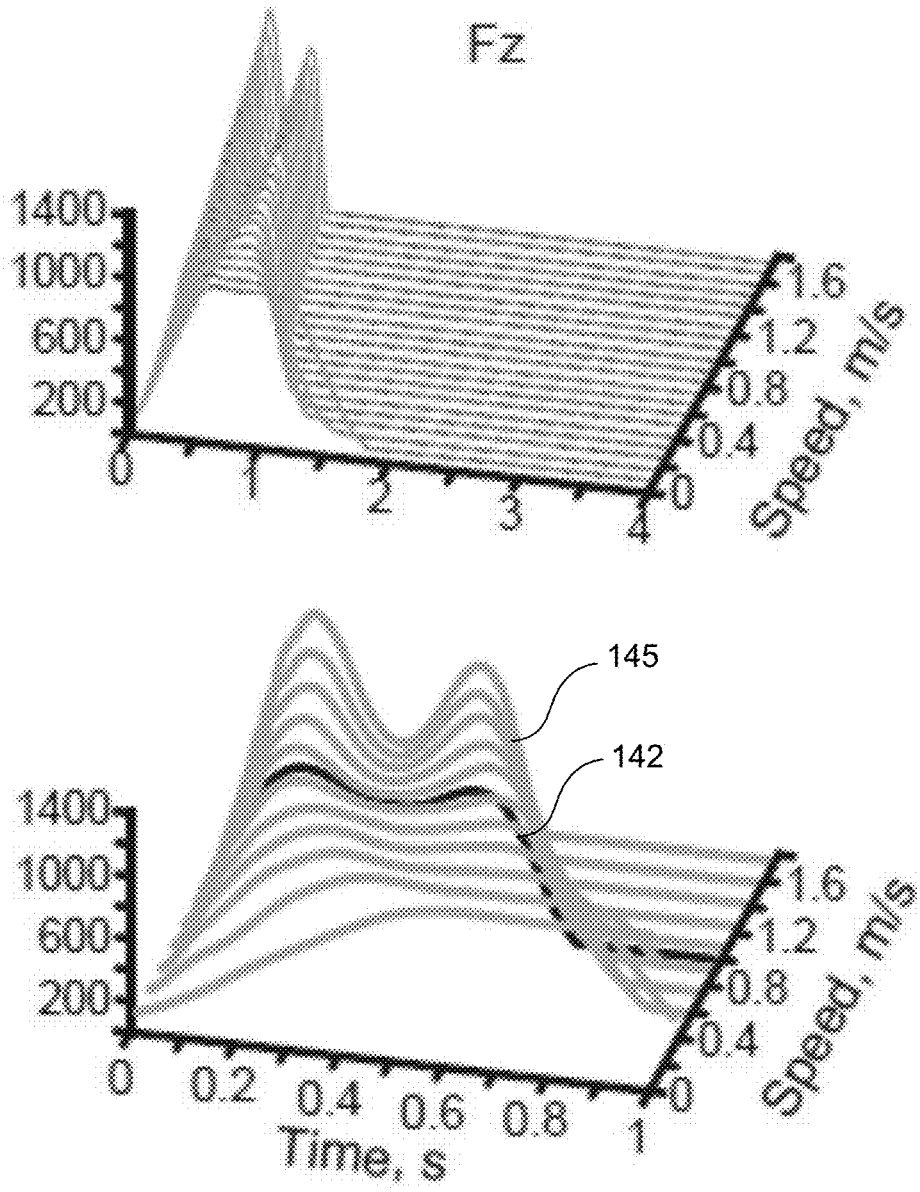

FIGS. 4A-4C illustrate graphs showing the ground reaction force surfaces created by walking at different speeds with an example of comparing of comparing a partial step profile to the dataset of locomotor profiles to determine the speed of the leg (bottom). FIG. 4A corresponds to the force direction $F_x$; FIG. 4B corresponds to the force direction $F_y$; and FIG. 4C corresponds to the force direction $F_z$. The recorded force 142 is compared to the dataset profiles 145 yielding the best correlation with the profile with the closest matching speed. The estimates of current speed from FF are available during the stance phase, when leg is on the ground.

These profiles also provide the tracking of performance across multiple sessions for each subject.

The bottom panel of FIGS. 4A-4C shows the detection of the current speed from only a portion of the GRF stance data. The best-fit relationship found as a dot product between observed 142 and binned 145 GRF profiles allows us to select the appropriate leg velocity estimation in FF. The search of best-fit match is done with a multi-step algorithm that starts with speed estimates from the GRF database subset with low precision and then refines these estimates using the highest precision GRF database (speed precision set to 0.01 m/s as shown in JND related tasks).

The next step is to find the uncertainty of the FF method. The partial profiles were drawn from the multidimensional GRF database with at least twenty steps per bin and used to estimate the velocity error profile as a function of observed sample size. The data used for testing was removed from the database before finding the speed estimates. This analysis was repeated on each step collected in the database to create the representation of uncertainty as a function of the observation period and the estimated speed.

The current and the previous speed estimates from the FF algorithm from the FF algorithm are combined with a Kalman filter. The sequential improvement of FF estimate is done within the stance phase and the Kalman filter is reset between steps. The output is the arrow that leaves the FF block 124 in FIG. 2 and goes to the hybrid controller 130.

E. Hybrid Controller

The hybrid controller 130 is the Kalman filter transformation that combines FB and FF estimates using standard Kalman Eq.5-7. Here, $V_{fb}$ and $V_{ff}$ are FB and FF velocity estimates with the corresponding uncertainty values $\sigma_{V_{fb}}$ and $\sigma_{V_{ff}}$, $V_H$ is the combined velocity estimate of the hybrid controller, and $\sigma_{V_H}$ is the corresponding uncertainty. If FB controller 120 and the FB controller 124 fail to produce estimates then the treadmill speed remains the same. If only one of the controllers produces a measurement, the hybrid controller sets that estimate and its uncertainty as the hybrid controller output to the final stage, the treadmill filter 127.

$$k = \frac{\sigma^2_{V_{fb}}}{\sigma^2_{V_{fb}} - \sigma^2_{V_{ff}}} \quad \text{Eq. 5}$$

$$V_H = V_{fb} + k(V_{ff} - V_{fb}) \quad \text{Eq. 6}$$

$$\sigma^2_{V_H} = \sigma^2_{V_{fb}} - k\sigma^2_{V_{ff}} \quad \text{Eq. 7}$$

F. Treadmill Kalman Filter

The final estimate of leg speed is a combination of previous and current estimates of speed. Similar to the calculations above, Equations 1-3 were used to combine previous and current estimates of speed. Here, x is the velocity of the treadmill belt with its uncertainty Cx, y is the hybrid velocity estimate and its uncertainty Cy; i is the current time step; and Q is additional uncertainty from the environment, which is JND of 0.01 m/s for a healthy subject.

G. SPT Hazard Rules

Hazard rules 138 are added to the output of all estimates to overwrite treadmill when hazard states are detected. The treadmill 100 stops the treadmill 100 if the user walks too far back and is at risk of sliding off the end of treadmill belt 106. To keep the subject 114 in the middle, the belt speed command has an additive term $V_{HR}$ calculated as the negative position feedback Eq. 8, x* is the absolute value of hazard position relative to the middle of treadmill, x is the current limb position, and $K_{HR}$ is the gain of feedback. The hazard rule manipulates belt speeds to move subject to the middle of the treadmill 100.

$$V_{HR} = K_{HR}(x^* - x) \quad \text{Eq. 8}$$

H. Virtual Reality Methods

MATLAB (commercially available from The MathWorks, Inc., U.S.A.) can be used for calculation of treadmill velocities and data transmission. Virtual reality (VR) environments can be created in any game development tool (e.g., Unreal Engine, etc.) and displayed to the subject 114 via a virtual reality headset (e.g., HTC Vive, etc).

1. Control of Heading Direction

The control of heading direction can be expressed as the differential signal between belt speeds for the locomotion on a curved path that does not require abrupt turning. Equation 9 captures the relationship between the counter clock-wise heading direction change (ΔV) as a geometric transformation of instantaneous limb speeds ($V_L$, $V_R$) and the step width (W) in the observed period (Δt). Since the method for the self-paced behavior on the instrumented split-belt treadmill 100 described above generates the speed estimates for each leg, the transformation in Equation 9 allows us to update the orientation of viewpoint in VR. Together, the self-paced method coupled to the heading direction control allow a subject 114 to walk in the VR environment 115. This method could also be used as a rehabilitation or testing tool to assess the level of interlimb velocity control within the visuomotor transformation. Moreover, subjects 114 can generate abrupt turns after a brief adaptation that decouples limb speeds from hip turning in the direction of heading, which is called the 'step' turning strategy.

$$\Delta\theta = \tan^{-1}\left(\frac{(V_L - V_R) \times \Delta t}{W}\right) \quad \text{Eq. 9}$$

Figure 5:
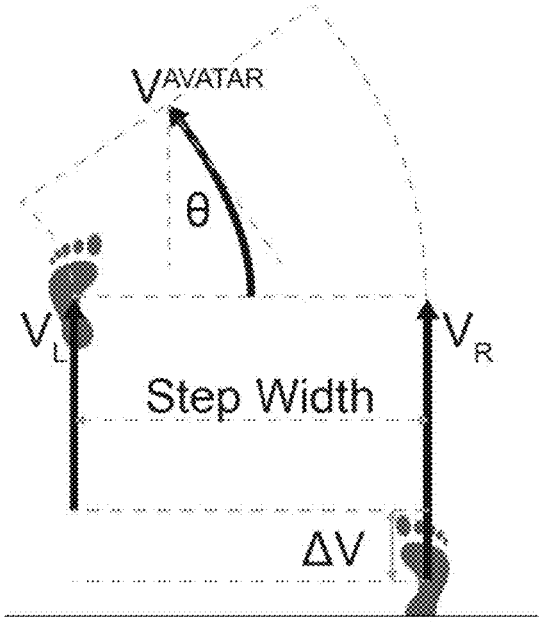
FIG. 5 represents the transformation from the asymmetric belt speeds on the treadmill (FIG. 2) to the change in the heading direction in virtual reality according to various embodiments of the present disclosure.
Figure 6:
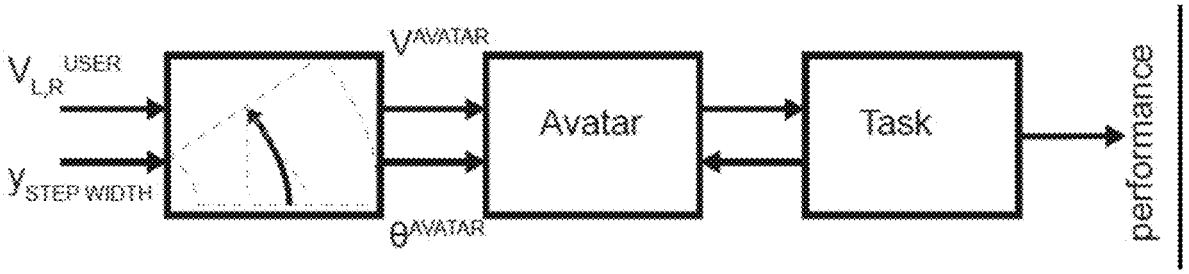
FIG. 6 is an example of a diagram showing the integration between self-paced treadmill and the virtual reality tasks in a computer based system according to various embodiments of the present disclosure. The belt speeds are inputs to compute the heading direction that can optionally use subject's current stance width to improve the accuracy in Equation 9. The heading direction determines the movement of subject's avatar who is providing the reference for congruent visual flow to subject's VR representation (e.g., helmet mounted display) and is the effector in the interactions with objects in VR tasks with logged performance.

The step width can be calculated from the GRF signals to improve accuracy. FIG. 5 shows the geometrical representation of Equation 9.

2. Connection to Treadmill

The treadmill belt speeds are sent to the treadmill 100 and to VR environment 115 at the same time. This allows the subject and the avatar in the virtual environment 115 to move in the same way.

3. Control of speed in VR

The VR character's walking speed is set in the virtual reality (VR) units scaled to the real world space representations. This is accomplished by matching VR unit during the creation of VR environments 115. The treadmill belt speed commands are then automatically calibrated to the appropriate speed of the VR avatar moving with the momentary heading direction change calculated with Equation 9 and the speed calculated as the average of leg speeds. The adjustment to the middle described in Equation 8 is not included in this calculation to mask these manipulations.

I. Computing Device

Figure 7:
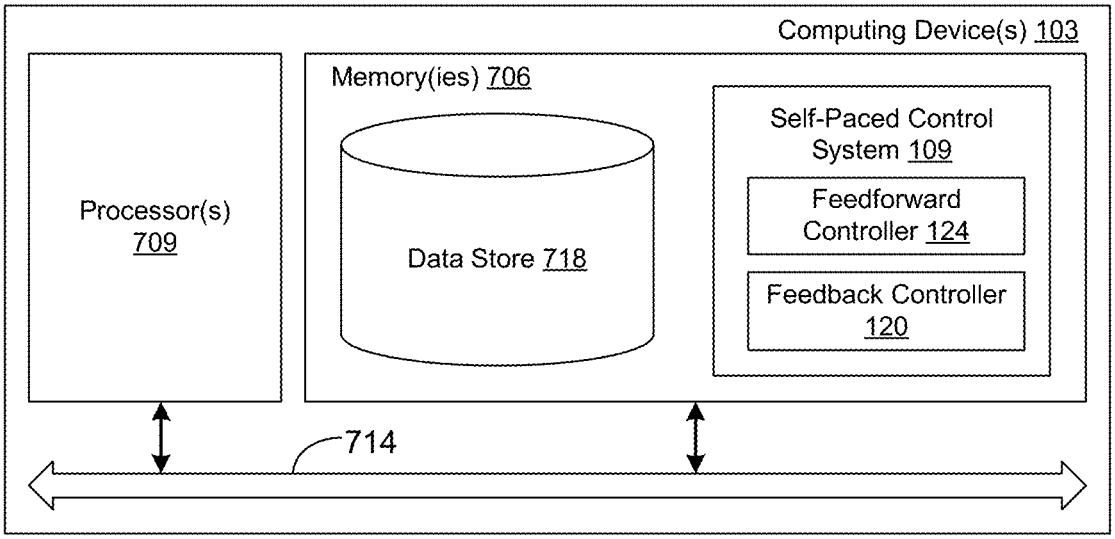
FIG. 7 is a schematic block diagram that provides one example illustration of a computing environment employed in the control system environment of FIG. 2 according to various embodiments of the present disclosure.

FIG. 7 shows a schematic block diagram of a computing device 103. Each computing device 103 includes at least one processor circuit, for example, having a processor 709 and a memory 706, both of which are coupled to a local interface 612. To this end, each computing device 103 may comprise, for example, at least one server computer or like device, which can be utilized in a cloud based environment. The local interface 612 may comprise, for example, a data bus with an accompanying address/control bus or other bus structure as can be appreciated.

In some embodiments, the computing device 103 can include one or more network interfaces 714. The network interface 714 may comprise, for example, a wireless transmitter, a wireless transceiver, and/or a wireless receiver. The network interface 714 can communicate to the self-paced treadmill 100, the VR environment 115, the sensors 112, a remote computing device or other components of the disclosed system using a Bluetooth, WiFi, or other appropriate wireless protocol. As one skilled in the art can appreciate, other wireless protocols may be used in the various embodiments of the present disclosure.

Stored in the memory 706 are both data and several components that are executable by the processor 709. In particular, stored in the memory 706 and executable by the processor 709 can be a self-paced control system 109, and potentially other applications. In this respect, the term "executable" means a program file that is in a form that can ultimately be run by the processor 709. Also stored in the memory 706 may be a data store 718 and other data. In addition, an operating system may be stored in the memory 706 and executable by the processor 709. It is understood that there may be other applications that are stored in the memory 706 and executable by the processor 709 as can be appreciated.

Examples of executable programs may be, for example, a compiled program that can be translated into machine code in a format that can be loaded into a random access portion of the memory 706 and run by the processor 709, source code that may be expressed in proper format such as object code that is capable of being loaded into a random access portion of the memory 706 and executed by the processor 709, or source code that may be interpreted by another executable program to generate instructions in a random access portion of the memory 706 to be executed by the processor 709, etc. Where any component discussed herein is implemented in the form of software, any one of a number of programming languages may be employed such as, for example, C, C++, C #, Objective C, Java®, JavaScript®, Perl, PHP, Visual Basic®, Python®, Ruby, Flash®, or other programming languages.

The memory 706 is defined herein as including both volatile and nonvolatile memory and data storage components. Volatile components are those that do not retain data values upon loss of power. Nonvolatile components are those that retain data upon a loss of power. Thus, the memory 706 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 709 may represent multiple processors 709 and/or multiple processor cores, and the memory 706 may represent multiple memories 706 that operate in parallel processing circuits, respectively. In such a case, the local interface 612 may be an appropriate network that facilitates communication between any two of the multiple processors 709, between any processor 709 and any of the memories 706, or between any two of the memories 706, etc. The local interface 612 may comprise additional systems designed to coordinate this communication, including, for example, performing load balancing. The processor 709 may be of electrical or of some other available construction.

Although the self-paced control system 109, and other various applications described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

Also, any logic or application described herein, including the self-paced control system 109, that comprises software or code can be embodied in any non-transitory computer-readable medium for use by or in connection with an instruction execution system such as, for example, a processor 709 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Further, any logic or application described herein, including the control system 615, may be implemented and structured in a variety of ways. For example, one or more applications described may be implemented as modules or components of a single application. Further, one or more applications described herein may be executed in shared or separate computing devices or a combination thereof. For example, a plurality of the applications described herein may execute in the same computing device 103, or in multiple computing devices in the same computing environment. To this end, each computing device 103 may comprise, for example, at least one server computer or like device, which can be utilized in a cloud based environment.

J. Variations and Modifications

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A method for a split belt treadmill having two belts, the method to enable each belt of the split belt treadmill to self-pace, the method comprising:

performing, via a computing device, a feedback process that estimates a first current step speed for a user by measuring stride length and step duration;

performing, via the computing device, a feed-forward process that estimates a second current step speed for the user by measuring three forces and three moment components associated with foot contact with the belt;

producing, via the computing device, a command speed for the belt by combining the first and second current step speeds with a Kalman filter; and adjusting, via the computing device, a belt speed associated with the belt based at least in part upon the command speed.

2. The method of claim 1, further comprising determining, via the computing device, a heading direction of the user in virtual reality based upon the belt speed associated with the two belts.

3. The method of claim 2, further comprising creating, via the computing device, a scene in a virtual reality system based at least in part upon the determined direction.

4. The method of claim 1, wherein the feedback process involves comparing a current profile of the stride length and the step duration with recorded profiles of the stride length and the step duration at different step speeds in order to estimate the first current step speed.

5. The method of claim 1, wherein the feedback process further comprises:

determining, via the computing device, a parameter based upon a speed change associated with the user; and wherein the Kalman filter produces the command speed based at least in part upon the parameter.

6. The method of claim 5, further comprising determining, via the computing device, a polynomial equation for and specific to the user that is used to compute the parameter.

7. The method of claim 1, wherein the feed-forward process involves comparing a current profile of the three forces and the three moment components with recorded profiles of the three forces and the three moment components at different speeds in order to estimate the second current step speed.

8. The method of claim 1, wherein the feed-forward process further comprises:

determining, via the computing device, an parameter based upon a time lapse from onset of a user step; and wherein the Kalman filter produces the command speed based at least in part upon the parameter.

9. The method of claim 8, further comprising determining a polynomial equation for and specific to the user that is used to compute the parameter.

10. A computer system designed to perform the method of claim 1.

11. The method of claim 1, wherein adjusting the belt speed of the belt of the split belt treadmill further comprises:

adjusting a first velocity of a first belt based at least in part on a first estimated speed of a first leg of the user; and adjusting a second velocity of a second belt based at least in part on a second estimated speed of a second leg of the user.

12. A system, comprising:

a treadmill comprising a belt;

at least one computing device; and at least one application executable in the at least one computing device, wherein, when executed, the at least one application causes the at least one computing device to at least:

receive sensor data associated with a subject interacting with the treadmill;

perform a feedback process to estimate a first current step speed and a second current step speed based at least in part on the sensor data, wherein the first current step speed is estimated by measuring stride length and step duration, and the second current step speed is estimated by measuring three forces and three moment components associated with foot contact with the belt;

determine a time-varying speed command by combining the first current step speed and the second current step speed; and cause a belt speed of the belt to be adjusted by transmitting the time-varying speed command to the treadmill, wherein the belt speed of the belt of the treadmill is adjusted based at least in part on the time-varying speed command.

13. The system of claim 12, wherein the stride length is based at least in part on a ratio of distance that a foot of the subject traveled during a step cycle.

14. The system of claim 12, wherein estimating the second current step speed comprises:

determining partial ground reaction forces (GRF) profiles using the sensor data; and comparing the partial GRF profiles with previously measured GRF profiles.

15. The system of claim 12, wherein the belt comprises a first belt and a second belt.

16. The system of claim 15, wherein adjusting the belt speed of the belt of the treadmill further comprises:

adjusting a first velocity of the first belt based at least in part on a first estimated speed of a first leg of the subject; and adjusting a second velocity of the second belt based at least in part on a second estimated speed of a second leg of the subject.

17. The system of claim 15, wherein the first current step speed and the second current step speed are combined in a filter.

18. The system of claim 12, wherein the sensor data is received from at least one sensor integrated within the treadmill.

19. The system of claim 12, wherein the sensor data is received from a kinematic sensor configured to be worn by the subject.

20. The system of claim 12, further comprising a virtual reality system, and wherein, when executed, the at least one application further causes the at least one computing device to at least transmit the time-varying speed command to the treadmill; and wherein the virtual reality system is configured to:

determine a direction of the subject in virtual reality based at least in part on the time-varying speed command; and create a virtual reality scene based at least in part upon the determined direction.

* * * * *